US006417742B1

(12) United States Patent
Enokuma

(10) Patent No.: US 6,417,742 B1
(45) Date of Patent: Jul. 9, 2002

(54) CIRCULAR POLARIZER HAVING TWO WAVEGUIDES FORMED WITH COAXIAL STRUCTURE

(75) Inventor: Shunji Enokuma, Osakasayama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/562,429

(22) Filed: May 2, 2000

(30) Foreign Application Priority Data

May 25, 1999 (JP) ..... 11-144314

(51) Int. Cl.[7] ..... H01P 1/165

(52) U.S. Cl. ..... 333/21 A; 333/157; 333/126; 333/135

(58) Field of Search ..... 333/21 A, 157, 333/126, 135

(56) References Cited

U.S. PATENT DOCUMENTS 4,725,795 A * 2/1988 Ajioka et al. ..... 333/157 X
5,724,050 A * 3/1998 Tokuda et al. ..... 333/21 A X

FOREIGN PATENT DOCUMENTS

JP 63-33206 3/1988
JP 4-267601 9/1992

* cited by examiner

*Primary Examiner*—Benny T. Lee
(74) *Attorney, Agent, or Firm*—Nixon & Vanderhye P.C.

(57) ABSTRACT

A circular polarizer includes a low frequency band waveguide ($f_L$), a high frequency band waveguide ($f_H$) formed at the inner side of the low frequency band waveguide ($f_L$) in a coaxial structure, and a dielectric member provided to abut against the inner side of the low frequency band waveguide ($f_L$) and the outer side of the high frequency band waveguide ($f_H$), and inclined by 45° with respect to a linear plane of polarization. Since the dielectric member is provided at an angle of 45° with respect to the linear plane of polarization, the delay of the phase of the electric field passing through the dielectric member becomes greater than the phase of the electric field orthogonal to the dielectric member, whereby a circularly polarized wave can be converted into a linearly polarized wave. Since the dielectric member can be formed by a mold, a circular polarizer that is economic and fit for mass production can be provided. Adjustment of the phase characteristics and the like is no longer required since the shape of the dielectric member can be determined by experiments.

13 Claims, 4 Drawing Sheets

CIRCULAR POLARIZER HAVING TWO WAVEGUIDES FORMED WITH COAXIAL STRUCTURE

BACKGROUND OF THE INVENTION

Field of the Invention

The present invention relates to a circular polarizer connected to a primary radiator of a parabolic antenna sharing two frequency bands, and particularly to a circular polarizer provided at an outer waveguide for a low frequency band in waveguides of the coaxial structure connected to a primary radiator.

Description of the Background Art

Recently, satellite broadcast receivers have become popular. In general, the polarized wave of a signal used in satellite broadcasting includes a circularly polarized wave in addition to a linearly polarized wave. FIG. 1 shows an example of an appearance of a parabolic antenna employed by a satellite broadcast received using the conventional circularly polarized wave. Referring to FIG. 1, the parabolic antenna includes a dish 51 reflecting a circularly polarized wave, a primary radiator 52 receiving the circularly polarized wave collected by dish 51, a circular polarizer 53 converting the circularly polarized wave received by primary radiator 52 into a linearly polarized wave, and a converter 54 converting the frequency of the linearly polarized wave output from circular polarizer 53. A circular polarizer is a polarized wave converter converting a linearly polarized wave into a circularly polarized wave, or a circularly polarized wave into a linearly polarized wave.

FIGS. 2A, 2B, 2C, 2D schematically show structures of conventional circular polarizers. These circular polarizers 53*a*, 53*b*, 53*c* and 53*d*, respectively convert a circularly polarized wave into a linearly polarized wave. The operation mechanism will be briefly described hereinafter.

In the case where a circularly polarized wave is to be converted into a linearly polarized wave, it is assumed that the two linearly polarized waves orthogonal to each other constitute the circularly polarized wave and the phases of the two linearly polarized waves are displaced by 90°. A circularly polarized wave Ec is converted into a linearly polarized wave Er by retarding the phase of the linearly polarized wave that is advanced 90° to set the phase difference to 0°.

For example, a dielectric phase plate 61 in a circular polarizer 53*a* shown in FIG. 2A is provided to have an angle of approximately 45° with respect to a linearly polarized wave Er that is to be converted. An electric field E1 parallel to dielectric phase plate 61 passes through dielectric phase plate 61, whereby the wavelength is reduced. As a result, the phase of electric field E1 is behind the phase of an electric field E2 orthogonal to dielectric phase plate 61. By setting this phase delay to 90°, the phase difference between electric fields E1 and E2 becomes 0°, whereby circularly polarized wave Ec can be converted into linearly polarized wave Er.

Circular polarizer 53*b* of FIG. 2B is provided with a plurality of cylindrical metal projections at the waveguide. By retarding the phase of electric field E1 90° by the cylindrical metal projection, circularly polarized wave Ec is converted into linearly polarized wave Er. Circular polarizer 53*c* of FIG. 2C is provided with an arc shape metal bulk within the waveguide. By retarding the phase of electric field E1 90° by the metal bulk, circularly polarized wave Ec is converted into linearly polarized wave Er. Circular polarizer 53*d* of FIG. 2D is provided with plate-like metal projections within the waveguide. By retarding the phase of electric field E1 90° by the plate-like metal projection, circularly polarized wave Ec is converted into linearly polarized wave Er.

The method of receiving as many channels as possible with one antenna includes the method of receiving the signals of two frequency bands transmitted from one satellite through one antenna, and the method of receiving the signals of two frequency bands transmitted from two satellites located on the same orbit through one antenna. These two different frequency bands correspond to, for example, the C band in the vicinity of 4 GHz and the Ku band in the vicinity of 12 GHz, or an arbitrary combination of frequency bands such as the Ka band in the vicinity of 20 GHz. Two primary radiators are required in order to receive the signals of two frequency bands remote from each other with a parabolic antenna.

The antenna that receives signals of two frequency bands transmitted from the same direction must have directivity with respect to the two frequency bands. In order to provide the same directivity with respect to the signals of two different frequency bands for the parabolic antenna, two primary radiators for the frequency bands must be provided at the focal position of the dish. The same applies for an antenna that carries out transmission and reception at different frequency bands with respect to one satellite.

FIG. 3A is a block diagram showing a schematic structure of a parabolic antenna for a linearly polarized wave where two primary radiators for the frequency bands are provided. This parabolic antenna includes a dish 51 reflecting a linearly polarized wave, a primary radiator 62 for a high frequency band (referred to as $f_H$) receiving the linearly polarized wave collected by dish 51, a primary radiator 63 for a low frequency band (referred to as $f_L$) receiving a linearly polarized wave collected by dish 51, a high frequency band ($f_H$) waveguide 64 transmitting a signal of a high frequency band received by high frequency band ($f_H$) primary radiator 62, and a low frequency band ($f_L$) waveguide 65 transmitting a signal of a low frequency band received by low frequency band ($f_L$) primary radiator 63. $f_H$ waveguide 64 and low frequency band ($f_L$) waveguide 65 are formed of the coaxial structure.

FIGS. 3B and 3C are diagrams to describe the electromagnetic mode of high frequency band ($f_H$) waveguide 64 and low frequency band ($f_L$) waveguide 65. Since high frequency band ($f_H$) waveguide 64 is a circular waveguide, the electromagnetic mode within the waveguide corresponds to the $TE_{11}$ mode of the general circular waveguide, as shown in FIG. 3B. Low frequency band waveguide ($f_L$) 65 is a coaxial waveguide having a conductor (high frequency band waveguide ($f_H$) at the center, so that the electromagnetic mode within the waveguide corresponds to the $TE_{11}$ mode as shown in FIG. 3C. In the case where a circular polarizer is to be provided at the inner high frequency band waveguide ($f_H$) 64 with respect to a parabolic antenna for a circularly polarized wave, a circular polarizer of any of the structures shown in FIGS. 2A–2D is to be employed within high frequency band ($f_H$) waveguide 64.

FIGS. 4A and 4B correspond to the case where a circular polarizer is provided at the outer $f_L$ waveguide 65. A plurality of cylindrical metal projections 82 are provided to have an angle of approximately 45° with respect to the linearly polarized wave Er (linearly polarized wave Er to be converted) of the $TE_{11}$ mode of a coaxial waveguide. Electric field E1 parallel to the plurality of cylindrical metal projections 82 passes cylindrical metal projections 82, whereby the wavelength is reduced. As a result, the phase of electric field E1 is behind the phase of electric field E2 orthogonal to cylindrical metal projections 82. By setting this phase lag to 90°, the phase difference between electric fields E1 and E2 becomes 0°. Thus, circularly polarized wave Ec can be converted into a linearly polarized wave Er.

Circular polarizer 81 provided with a plurality of cylindrical metal projections 82 shown in FIGS. 4A and 4B must have the phase and return loss optimized by altering the length of each cylindrical metal projection 82. For this purpose, cylindrical metal projection 82 must be formed of a vis whose length is adjusted one by one in the low frequency band waveguide ($f_L$).

FIG. 5 is a diagram to describe the method of adjusting the length of the, projection in the low frequency band waveguide ($f_L$). As shown in FIG. 5, circular coaxial waveguide converters 92 and 93 are disposed at both sides of circular polarizer 81. The length of cylindrical method projection 82 in the low frequency band waveguide ($f_L$) is adjusted while detecting the phase characteristics of the electric field and the return loss by a vector network analyzer 91.

The phrase characteristics and return loss of the electric field in the direction of E2 shown in FIG. 4A are measured. The phase characteristics refer to the phase lag frequency characteristics from the entrance to the exit of circular polarizer 81. Then, circular polarizer 81 is rotated 90°, and each projection 82 is inserted in a rotating manner one by one into the waveguide while observing the phase characteristics and the return loss of the electric field in the direction of E1. As each projection 82 is introduced into the waveguide, the phase lag of electric field R1 becomes greater than that of electric field E3, and the return loss of electric field E1 is also deteriorated. There is the case where the return loss becomes favorable by appropriately altering the length of each projection 82 in the waveguide. The length of each projection 82 is to be adjusted to achieve a favorable return loss.

Thus, the length of each projection 82 is adjusted until the phase lag of electric field E1 becomes greater than that of electric field E2 by approximately 90° and the return loss of electric field E1 attains a favorable level. Since the phase characteristics and return loss of the electric field in the direction of E2 differs from those of the state prior to the introduction of projection 82 when the length of each projection 82 has been adjusted, circular polarizer 81 is again rotated counterclockwise 90° to confirm the phase characteristics and return loss of the electric field in the direction of E2.

SUMMARY OF THE INVENTION

An object of the present invention is to provide a circular polarizer that can optimize the phase characteristics and return loss without adjustment.

Another object of the present invention is to provide a circular polarizer of a structure fit for mass production.

According to an aspect of the present invention, a circular polarizer includes a first waveguide, a second waveguide formed in a coaxial structure at the inner side of the first waveguide, and a dielectric member provided to abut against the inner side of the first waveguide and the outer side of the second waveguide, and inclined by approximately 45° with respect to a linear plane of polarization.

Since the dielectric member is provided inclined by approximately 45° with respect to the linear plane of polarization, the phase lag of the electric field passing through the dielectric member becomes greater than that of the electric field orthogonal to the dielectric member. Therefore, a circularly polarized wave can be converted into a linearly polarized wave. Also, the dielectric member can be formed by a mold to allow the provision of a circular polarizer that is economic and fit for mass production. Adjustment of the phase characteristics and the like is no longer required since the shape of the dielectric member can be determined by experiments.

According to another aspect of the present invention, a circular polarizer includes a first waveguide, a second waveguide formed with a coaxial structure at the inner side of the first waveguide, and a plate-like metal projection provided at the outer side of the second waveguide and inclined by approximately 45° with respect to the linear plane of polarization.

Since the plate-like metal projection is provided inclined by approximately 45° with respect to the linear plane of polarization, the phase lag of the electric field passing through the plate-like metal projection becomes greater than that of the electric field orthogonal to the plate-like metal projection. Thus, a circularly polarized wave can be converted into a linearly polarized wave. Also, since the plate-like metal projection can be formed with a mold identical to that of the second waveguide, a circular polarizer that is economic and fit for mass production can be provided. Furthermore, adjustment of the phase characteristics and the like is no longer required since the shape of the plate-like metal projection can be determined by experiments.

According to a further aspect of the present invention, a circular polarizer includes a first waveguide, and a second waveguide formed with a coaxial structure at an inner side of the first waveguide, having a cross section in the shape of an ellipse and provided so that the major axis direction of the ellipse has an angle of approximately 45° with respect to the linear plane of polarization.

Since the major axis direction of the ellipse is inclined by approximately 45° with respect to the linear plane of polarization, the phase lag of the electric field passing through the portion of the major axis direction of the ellipse becomes greater than that of the electric field orthogonal to the major axis direction of the ellipse of the elliptical configuration. Therefore, a circularly polarized wave can be converted into a linearly polarized wave. Also, since the elliptical shape can be formed by a mold identical to that of the second waveguide, a circular polarizer that is economic and fit for mass production can be provided. Furthermore, adjustment of the phase characteristics and the like are not required since the elliptical shape can be determined by experiments.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
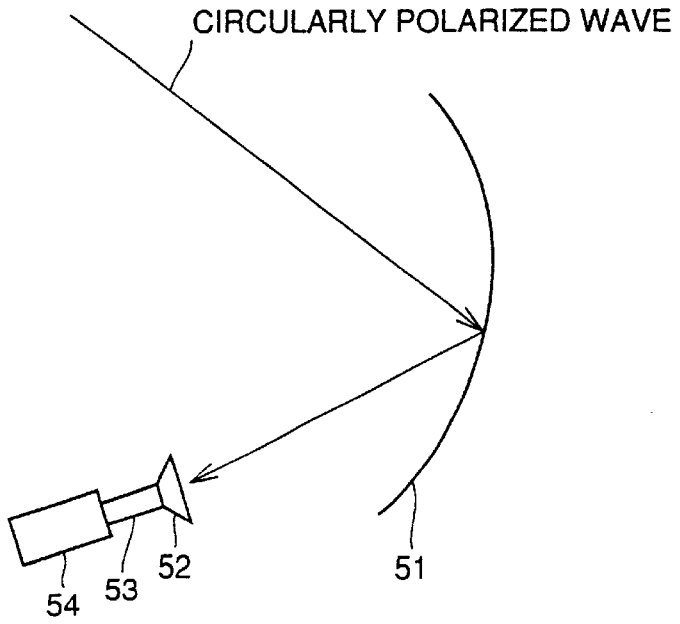
FIG. 1 PRIOR ART
FIG. 1 shows an example of an appearance of a parabolic antenna used in a satellite broadcast receiver employing a conventional circularly polarized wave.
Figure 2A:
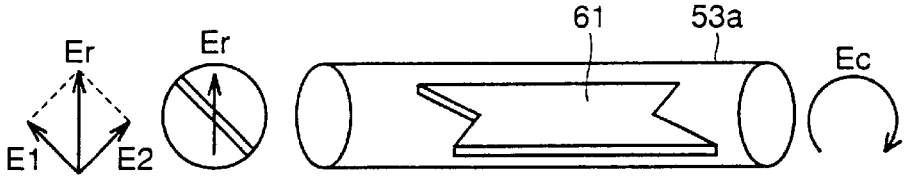
FIG. 2A PRIOR ART
FIGS. 2A, 2B, 2C and 2D show a schematic structure of a conventional circular polarizer.
Figure 2B:
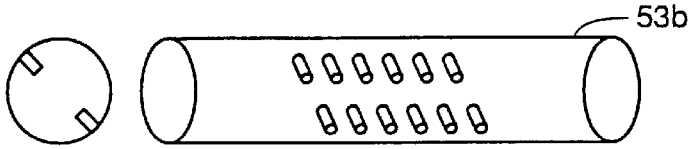
FIG. 2B PRIOR ART
Figure 2C:
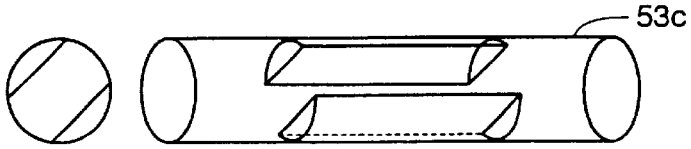
FIG. 2C PRIOR ART
Figure 2D:
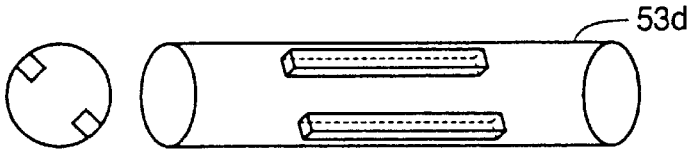
FIG. 2D PRIOR ART
Figure 3A:
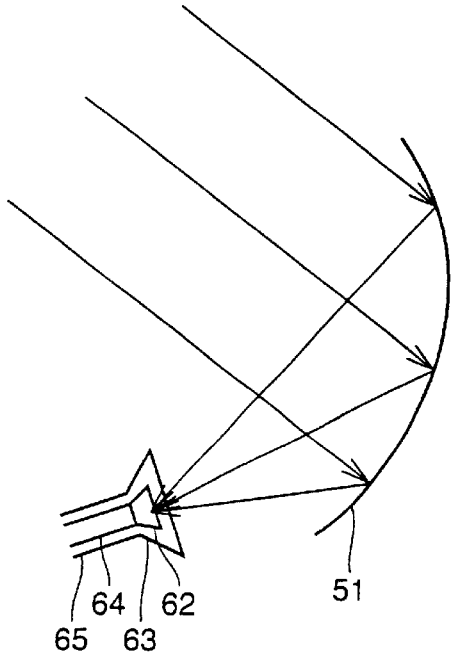
FIG. 3A PRIOR ART
FIG. 3A shows a schematic structure of a parabolic antenna provided with two primary radiators for the frequency bands.
Figure 3B:
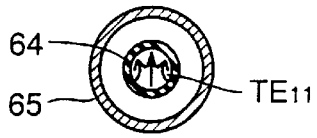
FIG. 3B PRIOR ART
FIGS. 3B and 3C are diagrams to describe an electromagnetic mode.
Figure 3C:
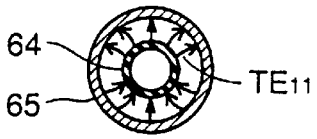
FIG. 3C PRIOR ART
Figure 4A:
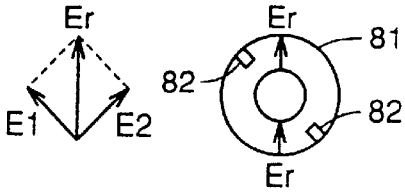
FIG. 4A PRIOR ART
FIGS. 4A and 4B show the case where a circular polarizer is provided at an outer low frequency band waveguide ($f_L$).
Figure 4B:
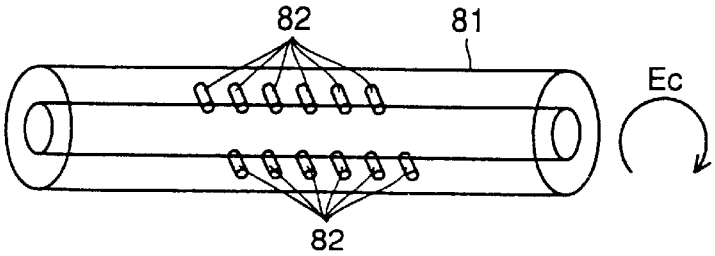
FIG. 4B PRIOR ART
Figure 5:
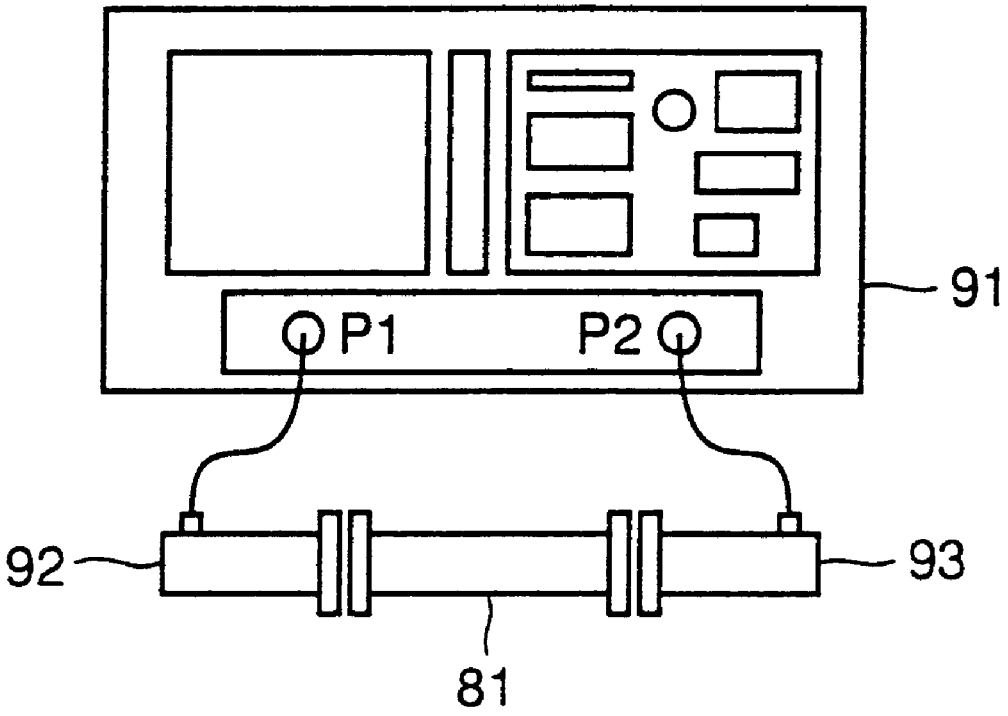
FIG. 5 PRIOR ART
FIG. 5 is a diagram to describe the method of adjusting the length of a projection in a low frequency band waveguide ($f_L$).
Figure 6A:
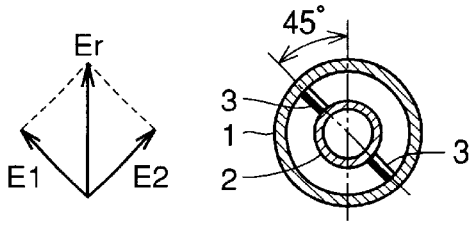
FIGS. 6A and 6B show a schematic structure of a circular polarizer according to a first embodiment of the present invention.
Figure 6B:
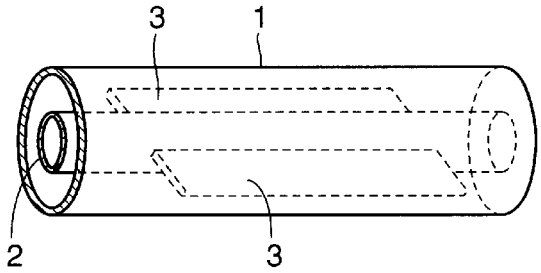

FIGS. 6A and 6B show a schematic structure of a circular polarizer according to a first embodiment of the present invention. The circular polarizer includes a low frequency band ($f_L$) waveguide 1 provided at the outer side, a high frequency band ($f_H$) waveguide 2 provided at the inner side, and a dielectric member 3 provided to abut against the inner side of low frequency band ($f_L$) waveguide 1 and the outer side of high frequency band ($f_H$) waveguide 2 low frequency band waveguide ($f_L$) 1 and high frequency band ($f_H$) waveguide 2 are formed of the coaxial structure. Two dielectric members 3 are provided between low frequency band ($f_L$) waveguide 1 and high frequency band ($f_H$) waveguide 2 to have an angle of approximately 45° with respect to a linearly polarized wave Er, and positioned approximately 180° with respect to each other.

Since the two dielectric members 3 have an angle of approximately 45° with respect to linearly polarized wave Er of the $TE_{11}$ mode of the coaxial waveguide, the electric field E1 parallel to dielectric member 3 has a phase behind that of the electric field E2 orthogonal to dielectric member 3. Dielectric member 3 is formed so that this phase lag is 90°. Accordingly, conversion into a linearly polarized wave Er is effected wherein electric field E1 passing through dielectric member 3 and electric field E2 not passing through dielectric member 3 are combined.

By determining in advance the material, shape, length or position of insertion and the like of the two dielectric members 3 by experiments to obtain the desired phase characteristics and return loss, an appropriate mold can be formed to allow mass production of the dielectric member 3. In the mass production stage, the circular polarizer can be constructed by just inserting dielectric member 3 formed by a mold at a predetermined position between low frequency band ($f_L$) waveguide 1 and high frequency band ($f_H$) waveguide 2. Therefore, a circular polarizer having the desired characteristics can be obtained without any adjustment that conventionally required a long period of time.

Regarding the coaxial waveguide, high frequency band ($f_H$) waveguide 2 must be arranged at the center of low frequency band ($f_L$) waveguide 1. However, a metal member cannot be used to support high frequency band ($f_H$) waveguide 2. If the support member is formed of a metal material, an electric field parallel to the support member will be reflected since the circularly polarized wave has its electric field rotated. In the circular polarizer of the present embodiment, the provision of dielectric member 3 between low frequency band ($f_L$) and high frequency band ($f_H$) waveguides 1 and 2 in an abutting manner allows high frequency band ($f_H$) waveguide 2 to be supported at the center of low frequency band ($f_L$) waveguide 1. The shape of dielectric member 3 is not limited to the continuous plate configuration shown in FIGS. 6A and 6B, and may be a discontinuous shape.

According to the circular polarizer of the present embodiment, time-consuming adjustment is no longer required. A circular polarizer that is economic and fit for mass production can be provided. Furthermore, high frequency band ($f_H$) waveguide 2 can be easily supported at the center of low frequency band ($f_L$) waveguide 1.

Figure 7A:
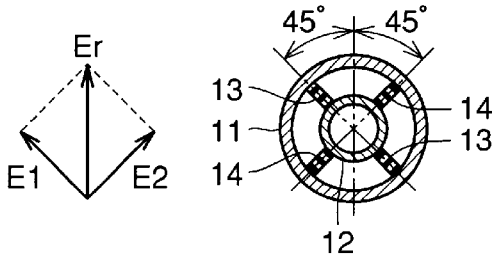
FIGS. 7A and 7B show a schematic structure of a circular polarizer according to a second embodiment of the present invention.
Figure 7B:
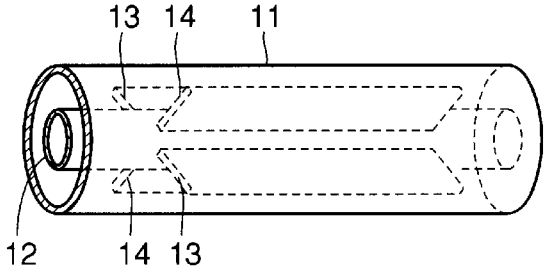

FIGS. 7A and 7B show a schematic structure of a circular polarizer according to a second embodiment of the present invention. The circular polarizer includes a low frequency band ($f_L$) waveguide 11 provided at the outer side, a high frequency band ($f_H$) waveguide 12 provided at the inner side, and dielectric members 13 and 14 provided to abut against the inner side of low frequency band ($f_L$) waveguide 11 and the outer side of high frequency band ($f_H$) waveguide 12. Loe frequency band waveguide ($f_L$) 11 and high frequency band ($f_H$) waveguide 12 are formed of the coaxial structure. Two dielectric members 13 are provided between low frequency band ($f_L$) waveguide 11 and high frequency band ($f_H$) waveguide 12, having an angle of approximately 45° with respect to linearly polarized wave Er and located approximately 180° with respect to each other. Also, two dielectric members 14 are provided at a position orthogonal to the two dielectric members 13. The material of dielectric members 13 and 14 is determined so that the relative dielectric constant of dielectric member 13 differs from that of dielectric member 14. Alternatively, dielectric members 13 and 14 can be formed of the same material to have the same dielectric constant, and altered in respective length.

Since dielectric member 13 has an angle of approximately 45° with respect to linearly polarized wave Er of the $TE_{11}$ mode of the coaxial waveguide and dielectric member 14 is arranged at a position orthogonal to dielectric member 13, difference is generated between the phase of electric field E1 passing through dielectric member 13 and the phase of electric field E2 passing through dielectric member 14. Dielectric members 13 and 14 are formed so that this phase difference is 90°. Thus, conversion into a linearly polarized wave Er can be effected wherein electric field E1 passing through dielectric member 13 is combined with electric field E2 passing through dielectric member 14.

By determining in advance the material, shape, length or position of insertion and the like of dielectric members 13 and 14 by experiments to obtain the desired phase characteristics and return loss, an appropriate mold can be formed to allow mass production of dielectric member 13. In the mass production stage, the circular polarizer can be constructed by just inserting dielectric members 13 and 14 formed by a mold at a predetermined position between low frequency band waveguide ($f_L$) 1 and high frequency band waveguide ($f_H$) 2. Therefore, a circular polarizer having the desired characteristics can be obtained without any adjustment that conventionally required a long period of time.

Similar to the coaxial waveguides of the first embodiment, high frequency band ($f_H$) waveguide 12 must be arranged at the center of low frequency band ($f_L$) waveguide 11. The provision of dielectric members 13 and 14 between low frequency band ($f_L$) and high frequency band ($f_H$) waveguides 11 and 12 in an abutting manner allows high frequency band ($f_H$) waveguide 12 to be supported at the center of low frequency band ($f_L$) waveguide 11 in the circular polarizer of the present embodiment.

According to the circular polarizer of the present embodiment, time-consuming adjustment is no longer required. A circular polarizer that is economic and fit for mass production can be provided. Furthermore, high frequency waveguide ($f_H$) 12, can be easily supported at the center of low frequency band waveguide ($f_L$) 11.

Third Embodiment

Figure 8A:
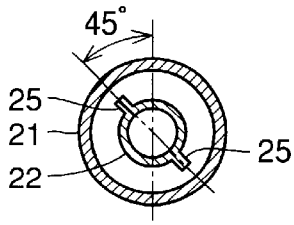
FIGS. 8A and 8B show a schematic structure of a circular polarizer according to a third embodiment of the present invention.
Figure 8B:
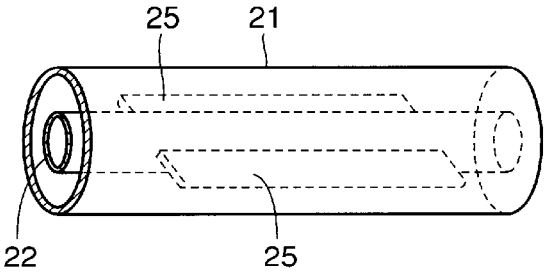

FIGS. 8A and 8B show a schematic structure of a circular polarizer according to a third embodiment of the present invention. The circular polarizer includes a low frequency band ($f_L$) waveguide 21 provided at the outer side, a high frequency band ($f_H$) waveguide 22 provided at the inner side, and two plate-like metal projections 25 provided at the outer side of high frequency band ($f_H$) waveguide 22. The low frequency band ($f_L$) and high frequency band ($f_H$) waveguides 21 and 22 are formed of the coaxial structure. Two plate-like metal projections 25 provided are provided at the outer side of high frequency band ($f_H$) waveguide 22 to have an angle of approximately 45° with respect to linearly polarized wave Er and at a position approximately 180° with respect to each other.

Since the two plate-like metal projections 25 have an angle of approximately 45° with respect to linearly polarized wave Er of the $TE_{11}$ mode of the coaxial waveguides and high frequency band ($f_H$) waveguide 22 provided with two plate-like metal projections 25 has a larger volume per unit length, the phase of electric field E1 parallel to plate-like metal projection 25 is behind the phase of electric field E2 orthogonal to plate-like metal projection 25. Plate-like metal projection 25 is formed so that the phase lag is 90°. Thus, conversion into linearly polarized wave Er can be effected wherein electric field E1 passing through plate-like metal projection 25 is combined with electric field E2 not passing through plate-like metal projection 25.

By determining in advance the material, shape, length or position of insertion and the like of the two plate-like metal projections 25 by experiments to obtain the desired phase characteristics and return loss, metal projection 25 can be formed with a mold identical to that of $f_H$ waveguide 22 to allow mass production. In the mass production stage, the circular polarizer can be constructed by just inserting high frequency band waveguide ($f_H$) 22 at a predetermined position in low frequency band waveguide ($f_L$) 21. Therefore, a circular polarizer having the desired characteristics can be obtained without any adjustment that conventionally required a long period of time.

According to the circular polarizer of the present embodiment, time-consuming adjustment is no longer required. A circular polarizer that is economic and fit for mass production can be provided.

Fourth Embodiment

Figure 9A:
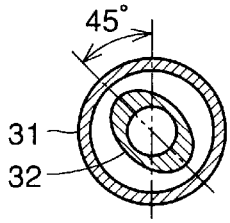
FIGS. 9A and 9B show a schematic structure of a circular polarizer according to a fourth embodiment of the present invention.
Figure 9B:
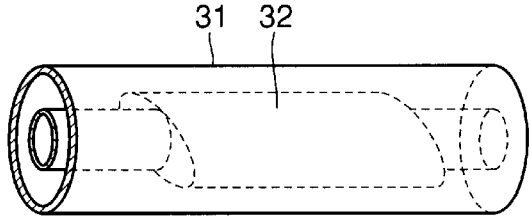

FIGS. 9A and 9B show a schematic structure of a circular polarizer according to a fourth embodiment of the present invention. The circular polarizer includes a low frequency band ($f_L$) waveguide 31 provided at the outer side and a high frequency band ($f_H$) waveguide 32 provided at the inner side. Low frequency band waveguide ($f_L$) 31 and high frequency band ($f_H$) waveguide 32 are formed of the coaxial structure. High frequency band waveguide ($f_H$) 32 is formed to have a cross section of an elliptical shape, and provided so that the major axis direction of the ellipse has an angle of approximately 45° with respect to linearly polarized wave Er.

Since the major axis direction of the ellipse of high frequency band ($f_H$) waveguide 32 has an angle of approximately 45° with respect to linearly polarized wave Er of the $TE_{11}$ mode of the coaxial waveguide and the portion of the major axis direction of high frequency band ($f_H$) waveguide 32 is increased in the volume per unit length, the phase of electric field E1 parallel to the major axis direction of the ellipse is behind the phase of electric field E2 orthogonal to the major axis direction of the ellipse. The elliptical shape of high frequency band ($f_H$) waveguide 32 is formed so that this phase delay becomes 90°. Thus, conversion into linearly polarized wave Er can be effected wherein electric field E1 passing through the portion of the major axis direction of high frequency band ($f_H$) waveguide 32 is combined with electric field E2 that does not pass the portion of the major axis direction of high frequency band ($f_H$) waveguide 32.

By determining in advance the material, shape, length or position of insertion and the like of the elliptical shape of high frequency band ($f_H$) waveguide 32 by experiments to obtain the desired phase characteristics and return loss, an appropriate elliptical shape can be formed with the mold of high frequency band ($f_H$) waveguide 32 to allow mass production. In the mass production stage, the circular polarizer can be constructed by just inserting high frequency band ($f_H$) waveguide 32 at a predetermined position in low frequency band ($f_L$) waveguide 32 at a predetermined position in low frequency band ($f_L$) waveguide 31. Therefore, a circular polarizer having the desired characteristics can be obtained without any adjustment that conventionally required a long period of time.

According to the circular polarizer of the present embodiment, time-consuming adjustment is no longer required. A circular polarizer that is economic and fit for mass production can be provided.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A circular polarizer comprising:

a first waveguide, a second waveguide disposed at an inner side of said first waveguide with a coaxial structure, and a dielectric member provided to abut against an inner side of said first waveguide and an outer side of said second waveguide, and inclined by approximately 45° with respect to a linear plane of polarization.

2. The circular polarizer according to claim 1, wherein said dielectric member includes two first dielectric members provided to be positioned approximately 180° with respect to each other.

3. The circular polarizer according to claim 2, wherein said first dielectric members provide support so that said second waveguide is located at the center of said first waveguide.

4. The circular polarizer according to claim 2, wherein said first dielectric members each have a plate shape continuous in an axial direction of said second waveguide.

5. The circular polarizer according to claim 2, further comprising two second dielectric members provided at positions orthogonal to said first dielectric members, and said second dielectric members each having a relative dielectric constant different from the relative dielectric constant of said first dielectric members.

6. The circular polarizer according to claim 5, wherein said second dielectric members provide support so that said second waveguide is located at the center of said first waveguide.

7. The circular polarizer according to claim 5, wherein said second dielectric members each have a plate shape continuous in an axial direction of said second waveguide.

8. The circular polarizer according to claim 2, further comprising two second dielectric members of different shapes, provided at positions orthogonal to said first dielectric members, and the second dielectric members each having a relative dielectric constant identical to the relative dielectric constant of said first dielectric members.

9. The circular polarizer according to claim 8, wherein said second dielectric members provide support so that said second waveguide is located at the center of said first waveguide.

10. The circular polarizer according to claim 8, wherein said second dielectric members each have a plate shape continuous in an axial direction of said second waveguide.

11. A circular polarizer comprising:

a first waveguide, a second waveguide disposed at an inner side of said first waveguide in a coaxial structure, and a plate-like metal projection provided at an outer side of said second waveguide, and inclined by approximately 45° with respect to a linear plane of polarization.

12. The circular polarizer according to claim 11, wherein said metal projection has a plate shape continuous in an axial direction of said second waveguide.

13. A circular polarizer comprising:

a first waveguide, and a second waveguide disposed at an inner side of said first waveguide in a coaxial structure, having a cross section of an ellipse, and provided so that a major axis direction of said ellipse is inclined by approximately 45° with respect to a linear plane of polarization.

* * * * *